US011131308B2

(12) United States Patent
Marica et al.

(10) Patent No.: US 11,131,308 B2
(45) Date of Patent: Sep. 28, 2021

(54) ELASTIC AND SEALING ELEMENTS IN MULTI-STAGE PUMPS

(71) Applicant: National Oilwell Varco, L.P., Houston, TX (US)

(72) Inventors: Adrian Marica, Houston, TX (US); Tim Burns, Houston, TX (US); Homer Hilburn, Houston, TX (US)

(73) Assignee: National Oilwell Vareo, L.P., Houston, TX (US)

( * ) Notice: Subject to any disclaimer, the term of this patent is extended or adjusted under 35 U.S.C. 154(b) by 275 days.

(21) Appl. No.: 16/307,733

(22) PCT Filed: Jun. 6, 2017

(86) PCT No.: PCT/US2017/036190

§ 371 (c)(1),
(2) Date: Dec. 6, 2018

(87) PCT Pub. No.: WO2017/214176

PCT Pub. Date: Dec. 14, 2017

(65) Prior Publication Data

US 2019/0257312 A1 Aug. 22, 2019

Related U.S. Application Data

(60) Provisional application No. 62/346,233, filed on Jun. 6, 2016.

(51) Int. Cl.
*F04D 13/10* (2006.01)
*F04D 1/06* (2006.01)
(Continued)

(52) U.S. Cl.
CPC ..... *F04D 1/06* (2013.01); *E21B 21/00* (2013.01); *F04D 13/10* (2013.01); *F04D 29/043* (2013.01);
(Continued)

(58) Field of Classification Search
CPC ..... F04D 1/06; F04D 13/10; F04D 29/043; F04D 29/086; F04D 29/20; F04D 29/668; F05D 2260/95; E21B 21/00
See application file for complete search history.

(56) References Cited

U.S. PATENT DOCUMENTS 2,339,186 A * 1/1944 Noble ..... F04D 1/06 415/111
2,739,252 A * 3/1956 Patterson ..... H02K 5/1285 310/87

(Continued)

OTHER PUBLICATIONS

International Search Report and Written Opinion dated Aug. 24, 2017, for Application No. PCT/US2017/036190.

*Primary Examiner* — Aaron R Eastman
(74) *Attorney, Agent, or Firm* — Conley Rose, P.C.

(57) ABSTRACT

A pump includes a driving shaft having a central axis, two retention members disposed on the driving shaft, a rotor disposed on the driving shaft between the two retention members, a bushing disposed on the driving shaft between the two retention members, a diffuser disposed about the driving shaft and adjacent the rotor such that the rotor is rotatably disposed within the diffuser, and an axial biasing member. The axial biasing member is disposed on the shaft and axially pre-loaded to compress the axial biasing member, the rotor, and the bushing between the two retention members and impart a tension in the driving shaft.

20 Claims, 8 Drawing Sheets

(51) Int. Cl.

| | |
|---|---|
| ***F04D 29/043*** | (2006.01) |
| ***F04D 29/08*** | (2006.01) |
| ***F04D 29/20*** | (2006.01) |
| ***F04D 29/66*** | (2006.01) |
| ***E21B 21/00*** | (2006.01) |

(52) U.S. Cl.
CPC ..... *F04D 29/086* (2013.01); *F04D 29/20* (2013.01); *F04D 29/668* (2013.01); *F05D 2260/95* (2013.01)

(56) References Cited

U.S. PATENT DOCUMENTS 2,749,992 A * 6/1956 Hill ..... F04C 14/04 166/106
2,808,111 A * 10/1957 Krueger ..... F04D 13/10 166/101
2,857,181 A * 10/1958 Myers ..... F04D 13/10 277/406
4,544,610 A * 10/1985 Okamoto ..... C22C 49/00 267/149
4,994,078 A * 2/1991 Jarvik ..... A61M 1/1003 415/900
5,336,048 A * 8/1994 Ganzon ..... F04D 29/128 415/175
10,677,032 B1 * 6/2020 Norton ..... E21B 34/10
2012/0205112 A1 * 8/2012 Pettigrew ..... F04D 29/445 166/308.1
2013/0126641 A1 * 5/2013 Pfeffer ..... F02C 7/232 239/533.9
2014/0262259 A1 * 9/2014 Fouillard ..... F04D 29/445 166/272.3
2016/0138597 A1 * 5/2016 LaRose ..... A61M 1/1029 417/420
2020/0095992 A1 * 3/2020 Semple ..... E21B 43/128
2020/0116152 A1 * 4/2020 Smith ..... F04D 29/043

* cited by examiner

ELASTIC AND SEALING ELEMENTS IN MULTI-STAGE PUMPS

CROSS-REFERENCE TO RELATED APPLICATIONS

This application is a 35 U.S.C. § 317 national stage application of PCT/US2017/036190 filed Jun. 6, 2017, and entitled "Elastic and Sealing Elements in Multi Stage Pumps" which claims benefit of U.S. provisional patent application Ser. No. 62/346,233 filed Jun. 6, 2016, and entitled "Elastic and Sealing Elements in Multi Stage Pumps," both of which are hereby incorporated herein by reference in their entirety.

STATEMENT REGARDING FEDERALLY SPONSORED RESEARCH OR DEVELOPMENT

Not applicable.

BACKGROUND

To form an oil or gas well, a bottom hole assembly (BHA), including a drill bit, is coupled to a length of drill pipe to form a drill string. The drill string is then inserted downhole from a drilling rig or other drilling structure at the well site, where drilling commences. During drilling, fluid, or "drilling mud," is circulated down through the drill string to lubricate and cool the drill bit as well as to provide a vehicle for removal of drill cuttings from the borehole. After exiting the bit, the drilling fluid returns to the surface through an annulus formed between the drill string and the surrounding borehole wall (or a casing pipe lining the borehole wall). Mud pumps are commonly used to pressurize the drilling fluid and deliver the drilling fluid to the drill string during drilling operations. Other fluids at the well site may also need pressurization by pumps, including other types of working fluids, processing fluids, or production fluids. For example, fluids other than drilling fluids may need to injected into the borehole, or fluids being produced from the borehole may need supplemental pressure for removal by a booster pump.

One pump commonly used to deliver drilling fluid to the drill string is a centrifugal pump. The centrifugal pump uses an impeller or rotor to accelerate the fluid and a diffuser or stator to re-direct the fluid exiting the rotor. For high volume pumping of drilling or other fluids at the well site as noted above, a series of staged or successively coupled centrifugal pumps is used. Multi-stage pumps, also called MSP pumps, include a succession of pump assemblies. Each pump assembly includes a rotor and a diffuser. The rotor is concentrically placed relative to the diffuser. A driving shaft is coupled through the rotor generally along the rotor axis, and rotates the rotor while the stator remains fixed. Each of the driving shaft, the rotor, and the stator are clamped into a surrounding pump housing or barrel, with each successive pump assembly coupled to the next within the barrel. The centrifugal force generated by the rotating rotor moves the fluid flowing up the rotor in a radial direction relative to the rotor axis, creating a high pressure zone at the rotor circumference.

In a centrifugal pump, the fluid enters through a suction or inlet port and is exhausted through a discharge or exhaust port. In the absence of a second pumping stage, the fluid exhausts the pump housing through a port placed tangentially relative to the suction port. In a multistage centrifugal pump, the fluid exhausted from one pumping stage enters the next stage through the corresponding inlet port. In each stage, the diffuser is concentric with the rotor and redirects the fluid exiting one stage so that it enters the rotor of the following pumping stage through the inlet port of that stage, the inlet port being concentric with the rotor as previously described. Thus, the diffuser assembly redirects the flow by changing its flow direction from a tangential to an axial flow relative to the surrounding cylindrical housing. Consequently, in a multistage centrifugal pump, the fluid is exhausted at a high pressure out of the pump since the fluid exhausted from one stage is the suction fluid of the following stage and so on until the fluid is exhausted from the final stage through a port that is concentrically placed relative to the cylindrical housing.

The driving shaft of a multi-stage centrifugal pump can experience large deflections because of the significant radial or axial loads applied to the shaft over the extended length of the shaft that couples through successive pump stages. In other words, because the driving shaft is long relative to the loads created by the multiple, successive pumps coupled to the shaft, the shaft can deflect easily. Consequently, the shaft is prone to rapidly achieving a multitude of resonant frequencies while rotating the plurality of rotors in the successive pump housings. At such resonant frequencies, the shaft exhibits large deflections. The driving shaft can also be exposed to various corrosive substances or media being pumped through the multi-stage pump.

SUMMARY

In some embodiments, a pump includes a driving shaft having a central axis, two retention members disposed on the driving shaft, a rotor disposed on the driving shaft between the two retention members, a bushing disposed on the driving shaft between the two retention members, a diffuser disposed about the driving shaft and adjacent the rotor such that the rotor is rotatably disposed within the diffuser, and an axial biasing member disposed on the shaft and axially pre-loaded to compress the axial biasing member, the rotor, and the bushing between the two retention members and impart a tension in the driving shaft. The pump may further include a plurality of bushings disposed on the driving shaft between the two retention members, wherein a first subset of the bushings is disposed on a first axial side of the rotor, and a second subset of the bushings is disposed on a second axial side of the rotor. The first axial side may be opposite the second axial side, and the axial biasing member may be configured to axially compress the plurality of bushings against one another, and against the rotor.

In some embodiments, the pump further includes a sealing element disposed between at least two of the plurality of bushings and against the driving shaft. The pump may further include a sealing element disposed between the rotor and the bushing at the driving shaft. In some embodiments, the pump further includes an outer housing having an inner surface, and an annular elastic member disposed about the diffuser and engaging the inner surface. The annular elastic member may sealingly engage with the inner surface.

In some embodiments, the axial biasing member is elastic. In some embodiments, the axial biasing member is metal. In some embodiments, the axial biasing member is non-metal. In some embodiments, the axial biasing member is a machined spring.

In some embodiments, a pump includes a driving shaft having a central axis, two retention members disposed on the driving shaft, a rotor disposed on the driving shaft between the two retention members, a plurality of bushings disposed on the driving shaft between the two retention members and on each side of the rotor, and an axial biasing member disposed on the shaft and axially pre-loaded to compress the axial biasing member, the rotor, and the plurality of bushings between the two retention members and impart a tension in the driving shaft. The axial biasing member may be pre-compressed, and the axial biasing member may expanded against one of the retention members to create the axial pre-load. The pump may include a sealing element disposed between the rotor and one of the plurality of bushings to prevent radial migration of a pumped fluid to the driving shaft. The driving shaft, the plurality of bushings, the rotor, and the axially pre-loaded biasing member may be compressed between the two retention members to form a centrifugal pump assembly, and a plurality of axially pre-loaded centrifugal pump assemblies may be disposed on the driving shaft. The pump may include a resonant frequency during use, and the plurality of axially pre-loaded centrifugal pump assemblies may impart a tension in the driving shaft that raises the resonant frequency. The pump may include a barrel and two end elements, and the plurality of axially pre-loaded centrifugal pump assemblies may be disposed on the driving shaft and inserted into the barrel and clamped by the two end elements.

In some embodiments, a method of assembling a pump includes assembling a retention member, a plurality of bushings, a rotor, a diffuser, and an axial biasing member on a driving shaft having a central axis, axially compressing the axial biasing member, coupling a second retention member on the driving shaft, expanding the axial biasing member against the second retention member to an axially pre-loaded position, and imparting a tension to the driving shaft in response to the axially pre-loaded position of the axial biasing member. The method may include disposing sealing elements between the rotor, the axial biasing member, and selected bushings, and against the driving shaft to prevent a working fluid from migrating to the driving shaft during use of the pump. The method may include raising a resonant frequency of the pump during use in response to the tension imparted to the driving shaft.

BRIEF DESCRIPTION OF THE DRAWINGS

For a detailed description of the disclosed embodiments of the disclosure, reference will now be made to the accompanying drawings in which.

DETAILED DESCRIPTION

Figure 1:
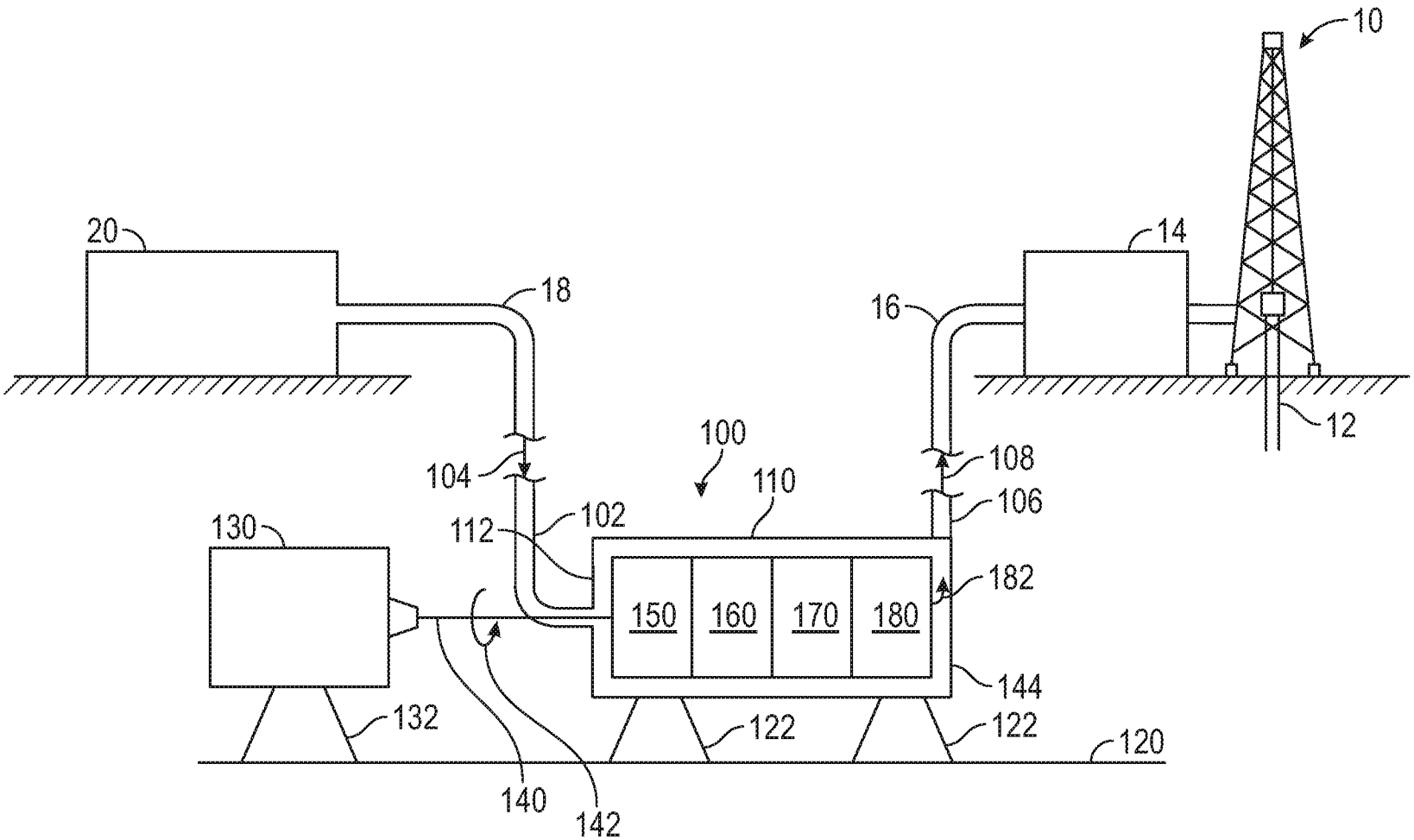
FIG. 1 is a schematic view of a multi-stage pump assembly fluidicly coupled between a fluid source and a drilling structure.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

The following description is directed to exemplary embodiments of a fluid pump assembly, a multi-stage fluid pump assembly, and a centrifugal fluid pump assembly. These embodiments are not to be interpreted or otherwise used as limiting the scope of the disclosure, including the claims. One skilled in the art will understand that the following description has broad application, and the discussion of any embodiment is meant only to be exemplary of that embodiment, and is not intended to suggest in any way that the scope of the disclosure, including the claims, is limited to that embodiment.

The drawing figures are not necessarily to scale. Certain features and components disclosed herein may be shown exaggerated in scale or in somewhat schematic form, and some details of conventional elements may not be shown in the interest of clarity and conciseness. In some of the figures, in order to improve clarity and conciseness of the figure, one or more components or aspects of a component may be omitted or may not have reference numerals identifying the features or components that are identified elsewhere. In addition, like or identical reference numerals may be used to identify common or similar elements. Features described below can be used or combined in various manners to achieve desired results.

Referring to FIG. 1, a pump assembly 100 is fluidicly coupled between a fluid source 20 and a drilling structure 10. In some embodiments, the pump assembly 100 is a multi-stage pump assembly, or a multi-stage centrifugal pump assembly. In some embodiments, the fluid source 20 is a drilling mud tank, but can also be other fluid sources as noted above, such as produced fluids that may need a booster pump to increase production flow. In some embodiments, the drilling structure 10 is land-based or sea-based, or serves to produce fluids from the borehole. For clarity, the detailed description below may refer to certain structures just noted, but it is understood that there is no limit on the number of pump stages, nor the type of fluid source or drilling or production structure.

The fluid source 20 is fluidicly coupled to the multi-stage pump assembly 100 by a conduit 18 that couples to a fluid inlet 102 to provide an inlet fluid flow 104. A housing or barrel 110 contains a series of coupled pumps 150, 160, 170, 180 of the multi-stage pump assembly 100. Rotors of the pumps 150, 160, 170, 180 are coupled to and rotated by a common driving shaft 140 that, in turn, is powered by an electric or otherwise rotating power mover 130. In some embodiments, the rotating power mover 130 is an internal combustion engine. The power mover 130 provides a rotation 142 to the driving shaft 140. The power mover 130 is supported by a base 132 that sits atop a skid or other support structure 120. The driving shaft 140 is keyed so that all of the rotors of the pumps 150, 160, 170, 180 are powered synchronously through the pump assembly 100. The pumps 150, 160, 170, 180 are contained by the pump housing or barrel 110 which is supported by bases 122 on the skid 120. The inlet fluid flow 104 is pressurized by the pumps 150, 160, 170, 180 to create a pressurized fluid flow 182 that flows through a fluid outlet 106 of the multi-stage pump assembly 100. The outlet 106 couples to a conduit 16 to provide a pressurized fluid source 108 to the drilling equipment 14 and drilling structure 10 and ultimately to the drill string 12. In some embodiments, the multi-stage pump assembly 100 includes more or less than the four pumps 150, 160, 170, 180.

Figure 2:
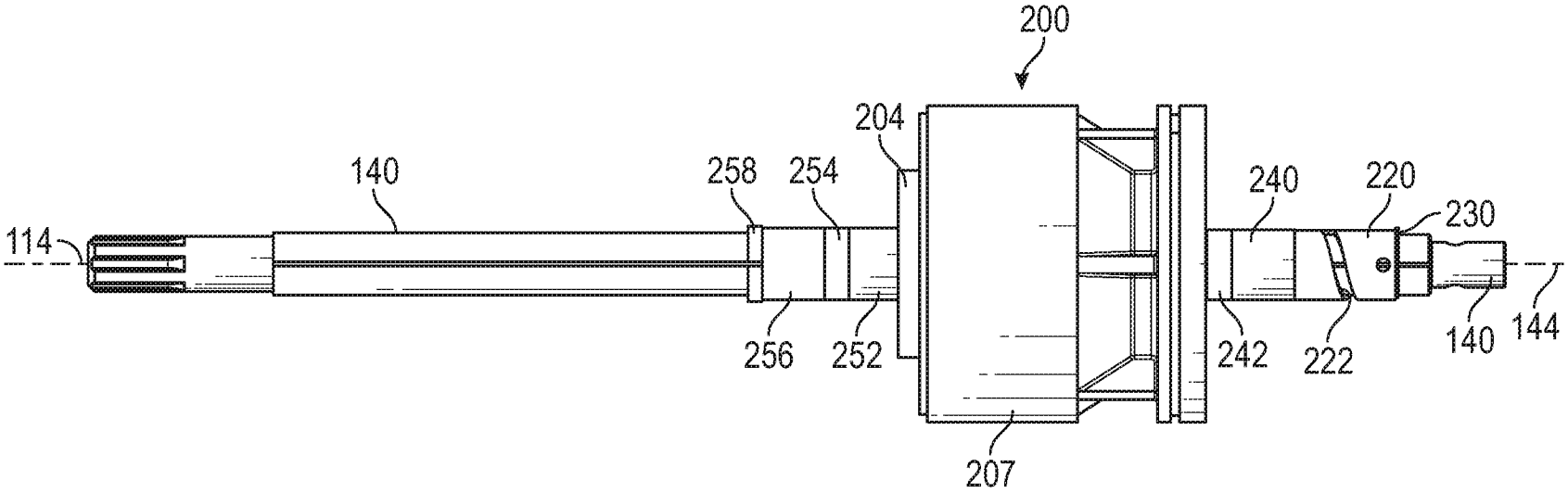
FIG. 2 is a side view of a centrifugal pump assembly coupled to a driving shaft and isolated from other centrifugal pump assemblies of the multi-stage pump assembly of FIG. 1, in accordance with principles disclosed herein.

As noted above, the driving shaft 140 is keyed so that all of the rotors of the pumps 150, 160, 170, 180 are powered synchronously through the pump assembly 100. However, the driving shaft 140 needs further support. Referring now to FIG. 2, a side view of an isolated or individual pump assembly 200 is shown in accordance with principles disclosed herein, including a diffuser or stator 202 and a rotor or impeller 204. The pump assembly 200 can be any one of the pumps 150, 160, 170, 180 disposed on the driving shaft 140. In some embodiments, the pump assembly 200 is a centrifugal pump and the description below will reference details of a centrifugal pump. As noted above, one or more pump assemblies 200 can be coupled together in the barrel 110 as needed.

For further support between the driving shaft 140 and the pumps 150, 160, 170, 180, a series of bushings are placed or mounted along the driving shaft 140. Referring still to FIG. 2, a bushing 240 and a bushing 242 are placed on the driving shaft 140 on the diffuser 202 side of the pump assembly 200, and a bushing 252, a bushing 254, and a bushing 256 are placed on the driving shaft 140 on the rotor 204 side of the pump assembly 200. A shoulder 258 engages the bushing 256 to act as a stop or retention member for the series of bushings extending through the pump assembly 200. As will be described in more detail below, an elastic element or axial biasing member 220 with cutout 222 is disposed between the bushing 240 and a snap or stop ring 230. The snap ring 230 acts as stop or retention member for the series of bushings extending through the pump assembly 200 in a similar manner to the shoulder 258 but in opposition to the retention function of the shoulder 258. The driving shaft 140 includes a longitudinal axis 144 around which the various bushings and retention members just described are generally concentric.

Figure 3:
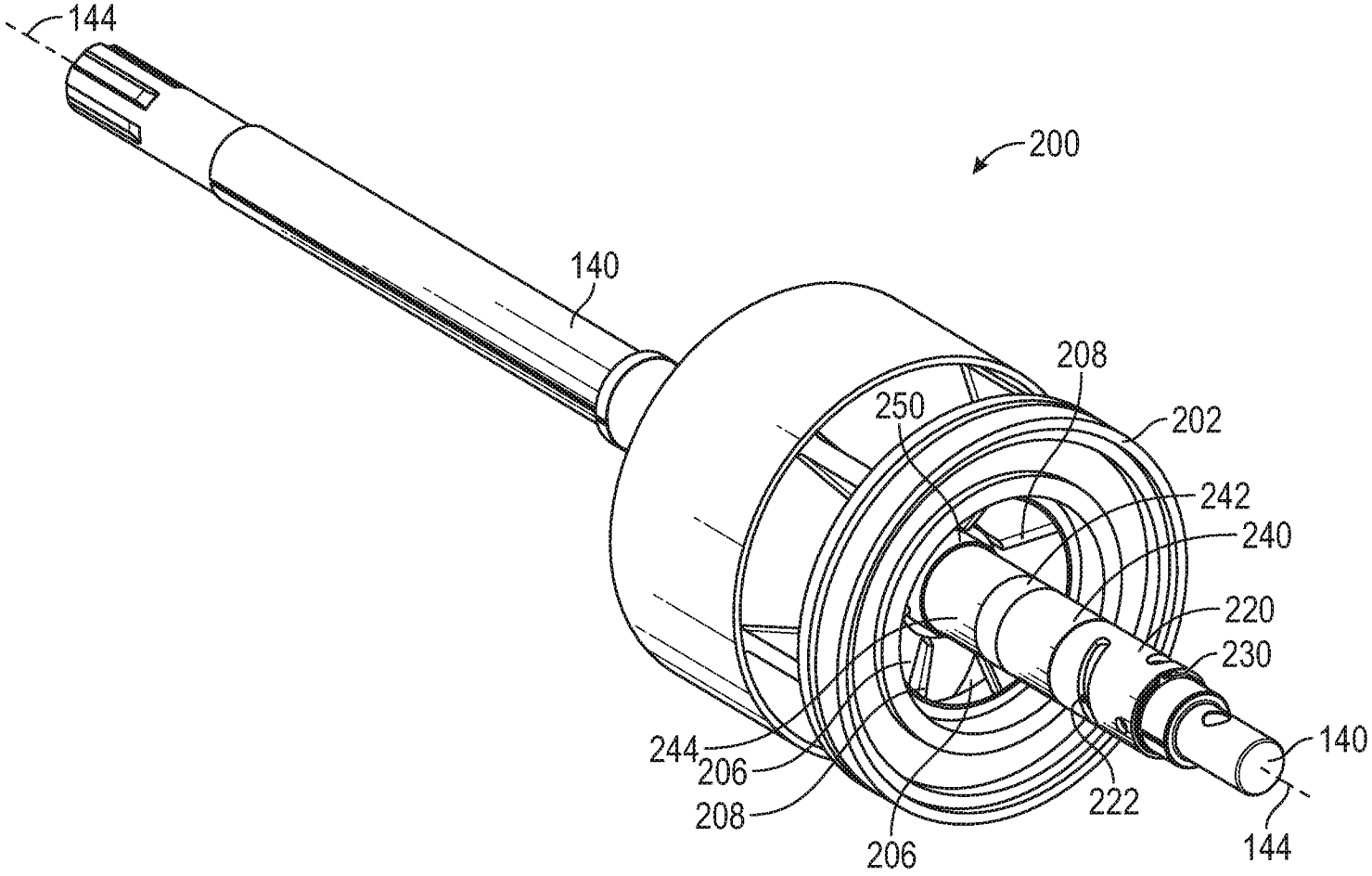
FIG. 3 is a perspective view of the centrifugal pump assembly of FIG. 2.

Referring next to FIG. 3, a perspective view of the pump assembly 200 is shown. The driving shaft 140 supports the snap ring 230, the elastic element 220, the bushing 240, the bushing 242, a bushing 244, and an inner diffuser bushing 250. In some embodiments, the bushings 240, 242, 244, 250 and 252, 254, 256 of FIG. 2 (which may also be together referred to as spacing bushings) are various axial lengths as measured along the driving shaft axis 144 in order to accommodate varying distances between the rotors 204 of successive pump assemblies 200. Different combinations of these bushings can be assembled between adjacent rotors 204 to account for slightly varying axial distances depending on pump configurations or pumping needs. An inner portion of the diffuser 202 includes diffuser blades 208 with flow paths 206 therebetween.

Figure 4:
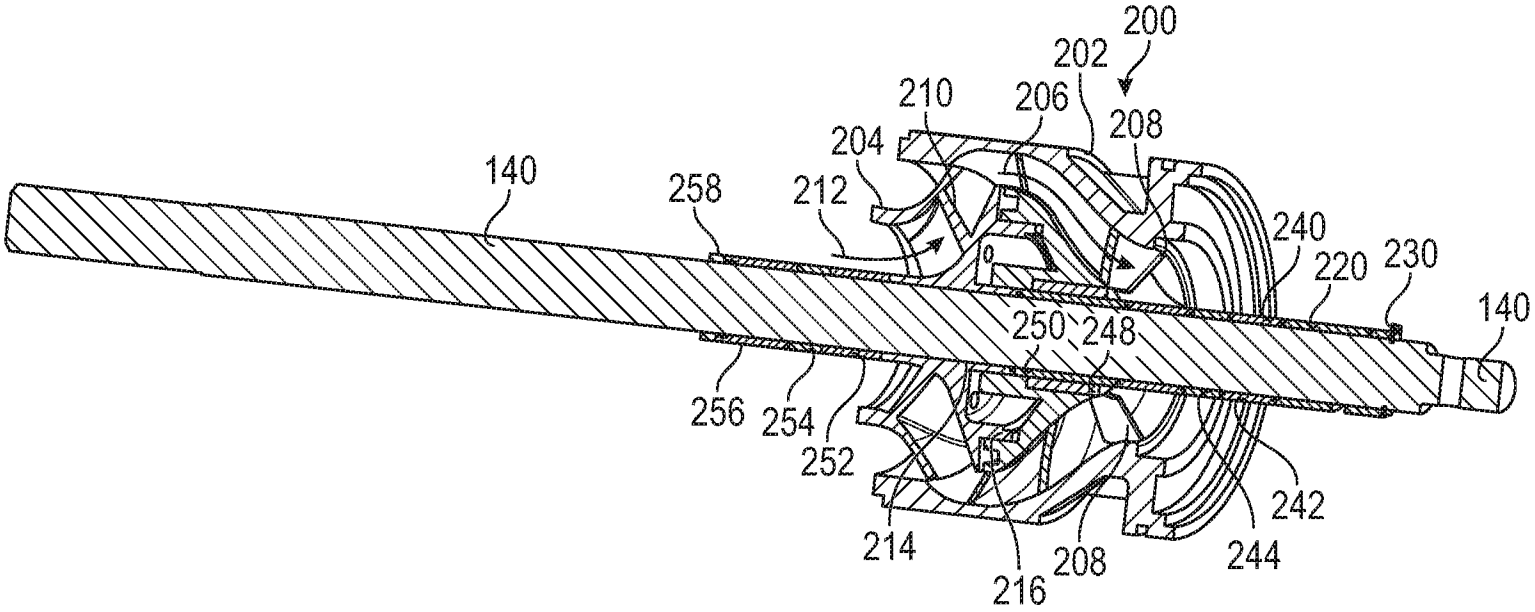
FIG. 4 is a cross-section view with an end perspective of the centrifugal pump assembly of FIGS. 2 and 3.
Figure 5:
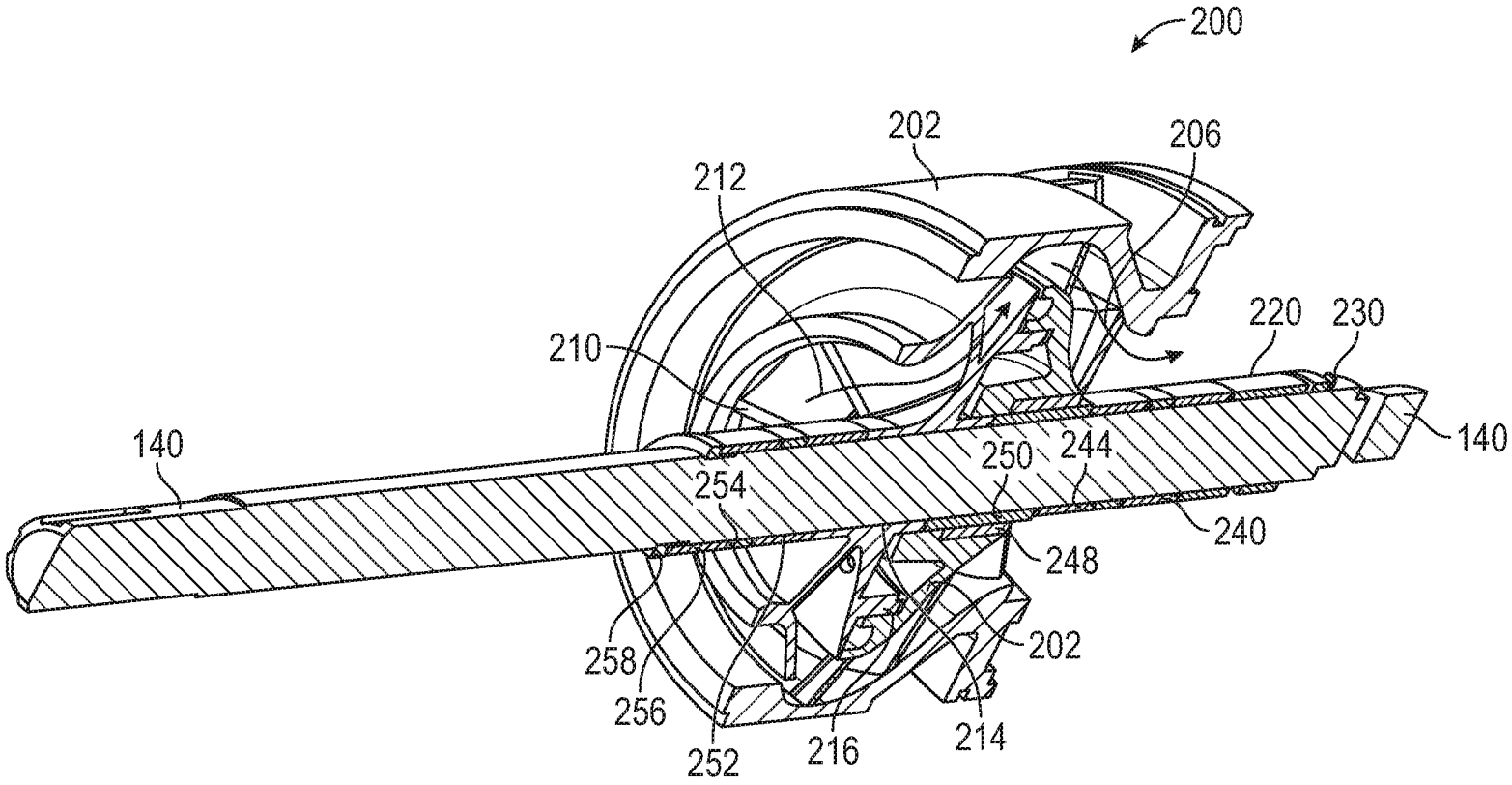
FIG. 5 is a cross-section view with another end perspective of the centrifugal pump assembly of FIGS. 2 and 3.

Referring next to FIGS. 4 and 5, cross-section views with different end perspectives of the pump assembly 200 are shown. The rotor 204 includes inner blades 210 for moving the pumped fluid along the flow paths 212, an interface 214 for supporting the rotor 204 on the driving shaft 140, and an end portion 216 for interfacing with the diffuser 202. The pumped fluid is accelerated by the rotating blades 210 along the flow path 212 which is fluidicly coupled to the flow path 216 of the diffuser 202 to direct the pumped fluid to the either the inlet of the next pump assembly 200 or the outlet 108 of the multi-stage pump assembly 100.

While the rotor 204 is supported on the driving shaft 140 by the rotor support interface 214, the diffuser 202 includes the inner diffuser bushing 250 as well as an outer diffuser bushing 248 captured between the diffuser 202 and the driving shaft 140. The bushings 240, 242, 244, 250 are captured between the rotor support interface 214 and the snap ring 230 to provide axial support for the pump assembly 200 along the driving shaft 140 on the diffuser 202 side of the pump assembly 200. The bushings 252, 254, 256 are captured between the rotor support interface 214 and the stop shoulder 258 to provide axial support for the pump assembly 200 along the driving shaft 140 on the rotor 204 side of the pump assembly 200. In some embodiments, the rotor 204 is keyed to the driving shaft 140 to rotationally couple the rotor 204 to the driving shaft 140. Consequently, the rotor 204 rotates with, i.e., is driven by, the driving shaft 140. In further embodiments, the diffuser side bushings 240, 242, 244, 250 and the rotor side bushings 252, 254, 256 are also keyed or rotationally coupled to the driving shaft 104, thereby causing the bushings to rotate with the driving shaft 140 and the rotor 204. In similar embodiments, the diffuser 202 is stationary or fixed.

As a result, in the multi-stage pump assembly 100 of FIG. 1, keyed bushings are placed or coupled along the driving shaft 140 shaft in between the series of rotors 204 that are in the pumps 150, 160, 170, 180. Certain of these keyed bushings, e.g., the inner diffuser bushings 250, engage with the corresponding outer diffuser bushings 248 in the diffusers 202. Thus, the rotating group of components includes a succession of rotors 204 and intervening bushings all placed on the driving shaft 140 of appropriate length. This rotating group of components is concentrically placed inside the cylindrical pump housing or barrel 110 that houses and supports the diffusers 202. The driving shaft 140 is supported at intervals by disposing certain of the rotating keyed bushings that separate the rotors 204, i.e., the inner diffuser bushings 250, inside the diffusers 202, i.e., at the outer diffuser bushings 248. The entire multi-stage pump assembly 100 is secured at both ends of the barrel 110 by end elements 112, 114. The end elements 112, 114 are designed with axial openings or ports. Thus, the opening at one end of the barrel 110 functions as the suction port or inlet 102, while the opening at the opposite end functions as the discharge or exhaust port, i.e., the fluid outlet 106.

The end elements 112, 114 also have the function of axially clamping the diffusers 202 inside the barrel 110 and to direct the fluid being pumped inside the barrel 110 and exhausting from the barrel 110. Accordingly, during operation, the rotors 204 rotate with the driving shaft 140 relative to the diffusers 202 to pressurize and pump fluids. As shown in FIGS. 2-5, the plurality of spacing bushings and other concentric components are disposed about the driving shaft 140 on either axial end or side of one of the rotors 204. These concentric components engage with and are captured between the retention or stop members, i.e., the shoulder 258 and the snap ring 230, disposed along the driving shaft 140 so that their axial positions along the driving shaft 140 are limited by the retention members.

In some embodiments, the rotors 204 and the adjacent bushings 240, 242, 244, 250 and bushings 252, 254, 256, without the axial biasing member 220, are assembled with slight spaces or play between them (e.g., axial, radial, tangential play). Thus, even when assembled, the rotors 204 and the bushings 240, 242, 244, 250, 252, 254, 256 can move axially on the driving shaft 140 in between the retention members 258, 230 placed at the ends. Furthermore, the driving shaft 140, the rotors 204, the diffusers 202, and the bushings 240, 242, 244, 250, 252, 254, 256 are concentric relative to each other but do not have to be concentric relative to the barrel 110 because these components are clamped inside the barrel 110 by and in between the end elements 112, 114. Consequently, the driving shaft, rotors, diffusers, and spacing bushings may be radially offset from the central axis of the barrel 110 when assembled and operating. Thus, by design, the driving shaft 140 can move axially relative to the mounting frame while the rotors and spacing bushings can move axially between the retention members and relative to the driving shaft 140 as well. Such a design enables the driving shaft 140 to move and distort axially and radially inside, in between, and together with the rotors and spacing bushings, much as a long tubular member will sag or bend under its own weight or other applied forces.

In further embodiments, the assembly of the rotor 204 and the concentric spacing bushings 240, 242, 244, 250, 252, 254, 256 on the driving shaft 140 also includes the concentric axial biasing member 220 as shown in FIGS. 2-5. In some embodiments, the axial biasing member 220 is concentrically disposed on the driving shaft 140 between the bushing 240 and the snap ring 230. In other embodiments, the axial biasing member 220 is located at other axial positions along the driving shaft 140. Because of the elasticity or biasing capability of the axial biasing member 230, it bears against each of the snap ring 230 and the spacing bushings via the bushing 240 to thereby axially compress the rotor 204 and the spacing bushings against the shoulder 258. Such a compression force between the axially fixed shoulder 258 and the axially fixed snap ring 230 imparts a tension in the driving shaft 140, as will be more fully explained below.

Figure 6:
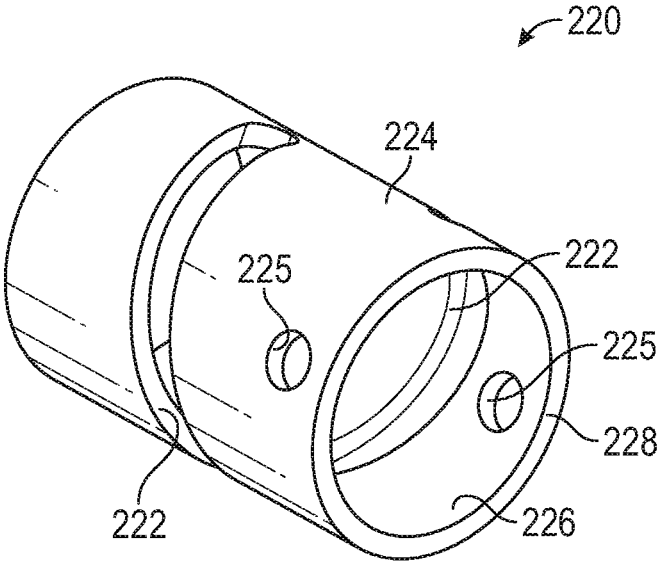
FIG. 6 is a perspective view of the axial biasing member of FIGS. 2-5.

Referring next to FIG. 6, in some embodiments the axial biasing member 220 is an annular, tubular shaped component made from an elastic material. A cylindrical outer surface 224 and a cylindrical inner surface 226 define a tubular body 228. The tubular body 228 may include one or more apertures or openings 225. The tubular body 228 also includes one or more cutouts or grooves 222. In some embodiments, the cutouts 222 are helical. In some embodiments, the cutouts 222 are cut or machined into the tubular body 228 to allow the biasing member 220 to be compressed axially. Though the axial biasing member 220 is elastic, in some embodiments the material is non-metal while in other embodiments the material is metal. In some embodiments, the axial biasing member 220 is a machined spring. In some embodiments, the axial biasing member 220 is a machined spring such as those sold by Helical Products Company and MW Industries, Inc. at www.machinedsprings.com. In addition, in at least some embodiments, the axial biasing member 220 is configured to impart a non-linear axially directed biasing force along the axis of the driving shaft 140. Specifically, in these embodiments, as the axial biasing member 220 is axially compressed relative to the driving shaft 140, the biasing force exerted on the driving shaft 140, the rotor 204, and the spacing bushings by the axial biasing member 220 increases along a non-linear profile (e.g., exponentially).

Figure 7:
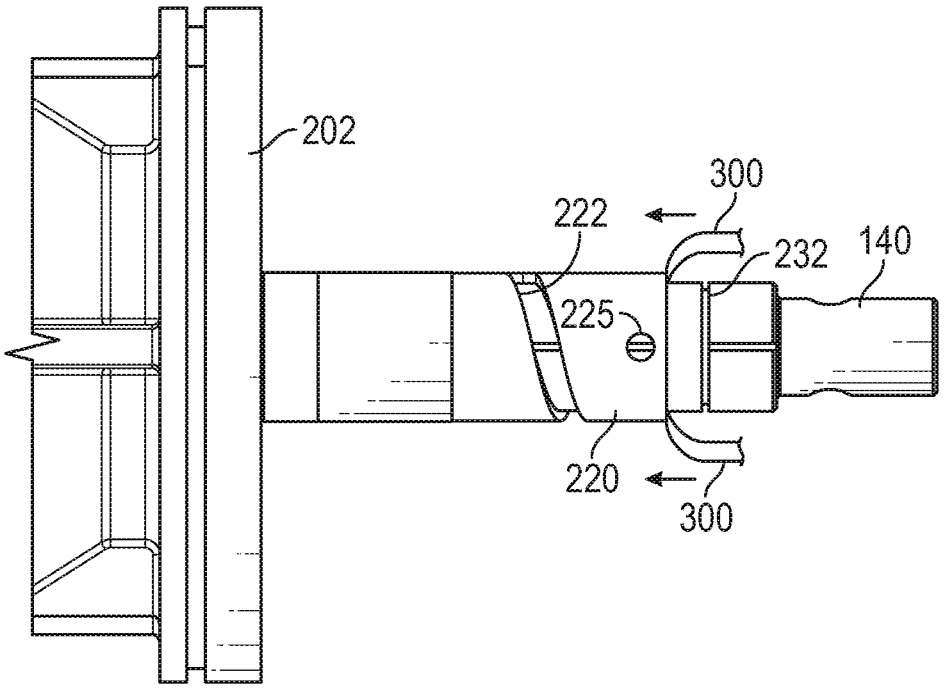
FIG. 7 is a side view of the compression tool pre-loading of the axial biasing member of FIG. 2-5.
Figure 8:
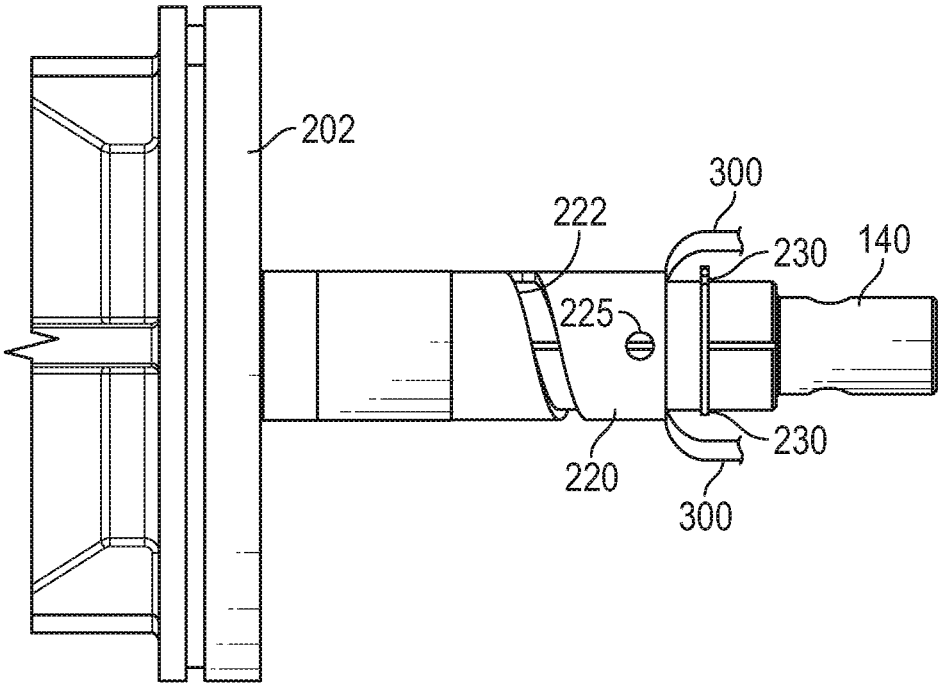
FIG. 8 is a side view of the installation of the snap ring adjacent the compression tool pre-loading of the axial biasing member.
Figure 9:
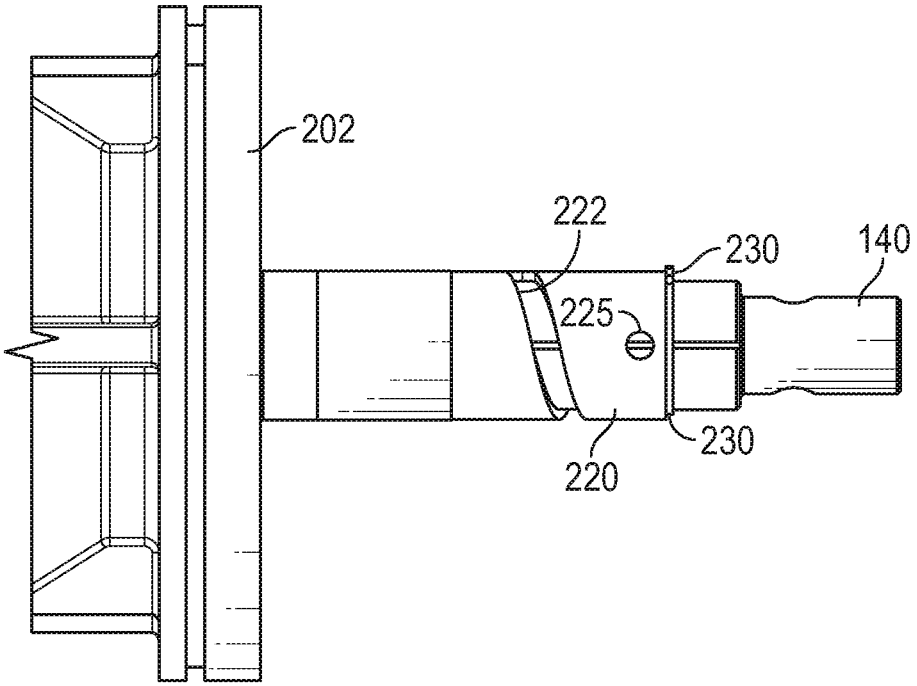
FIG. 9 is a side view of the axial biasing member being released by the compression tool to an axial pre-load position against the snap ring.

During assembly, after the rotor 204, the stator 202, the shoulder 258, the spacing bushings 240, 242, 244, 250, 252, 254, 256, and the axial biasing member 220 are disposed about the driving shaft 140 as shown in FIG. 2-5, the axial biasing member 220 is pre-compressed or pre-loaded axially. Referring now to FIG. 7, a compression tool 300 axially compresses the end of the axial biasing member 220 to a location axially past a snap ring groove 232. The snap ring 230 is not yet installed. The helical cutout 222 and the elasticity of the axial biasing member material allow the axial biasing member 220 to compress while maintaining the ability to return to an expanded position. In an uncompressed or relaxed position, the axial biasing member extends past the snap ring groove 232 on the driving shaft 140. While the axial biasing member 220 is compressed, and with reference now to FIG. 8, the snap ring 230 is placed over the end of the driving shaft 140 and into the snap ring groove 232. In some embodiments, the snap ring 230 is snapped into place in the snap ring groove 232. In other embodiments, other attachable rings, shoulders, or stop members are coupled into the position shown for the snap ring 230. Referring next to FIG. 9, the compression tool 300 is released or removed and the elastic biasing member 220 expands to an axially pre-loaded position against the snap ring 230. The snap ring 230 prevents the axial biasing member 220 from returning to the fully uncompressed or relaxed position, thereby keeping the axial biasing member 220 under an axial load.

Figure 10:
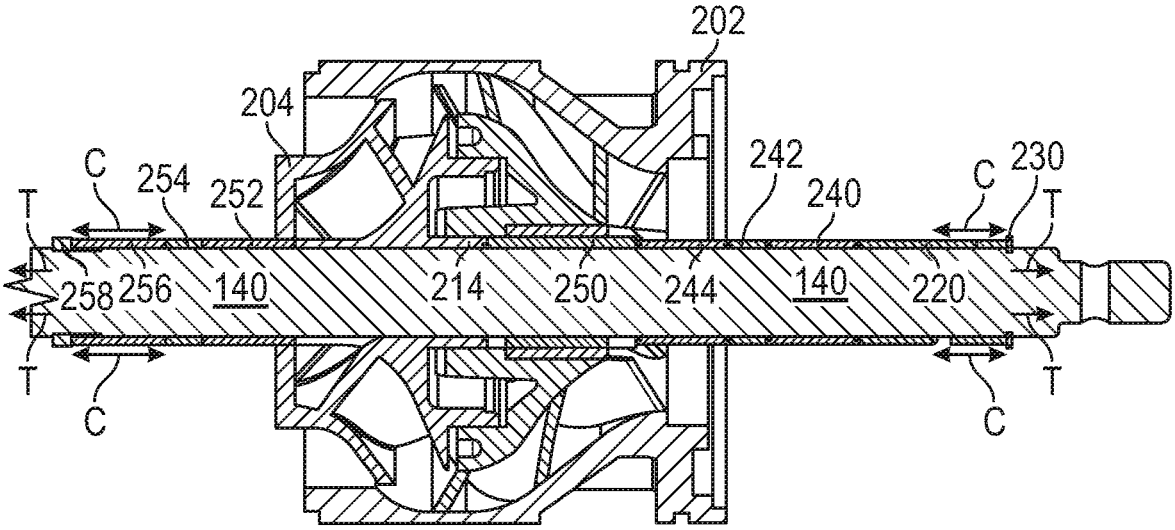
FIG. 10 is a cross-section view of the resulting tension in the driving shaft of FIGS. 2-5 due to the compression by the pre-loaded axial biasing member.

The axial biasing member 220 is axially pre-compressed and locked in place via the snap ring 230 so that the axial biasing member 220 can provide a predetermined biasing force to the rotor, the spacing bushings, and the driving shaft that are captured between the shoulder 258 and the snap ring 230. Without being limited to this or any other theory, in some embodiments this predetermined biasing force or load can be chosen to place a predetermined tension in the driving shaft 140 which adjusts (e.g., raises) the resulting resonant frequencies for the multi-stage pump assembly 100 (e.g., raises the resonant frequencies above the expected operating frequencies) so that resonance of the multi-stage pump assembly 100 may be avoided or at least minimized during operations. Referring to FIG. 10, the axially compressed and pre-loaded biasing member 220 compresses the bushings 240, 242, 244, 250, 252, 254, 256 and the rotor support interface 214 between the snap ring 230 and the shoulder 258, i.e., the two retention members, as indicated by the compression arrows C. Because the snap ring 230 and the shoulder 258 are fixedly coupled to the driving shaft 140 while retaining compressed components, a resulting tension T is imparted to the driving shaft 140. As a further result, any axial play or tolerances between the spacing bushings and the rotor 204 are reduced or eliminated by the biasing force of the axial biasing member 220. In some embodiments, the tension T applied to the driving shaft 140 and the compression C applied to the concentric spacing bushings and the rotor 204 via the axial biasing member 220 may make the resonant frequencies of the pump assembly 100 (e.g., the driving shaft 140) more predictable so that operators may more easily avoid such frequencies during operations.

Figure 11:
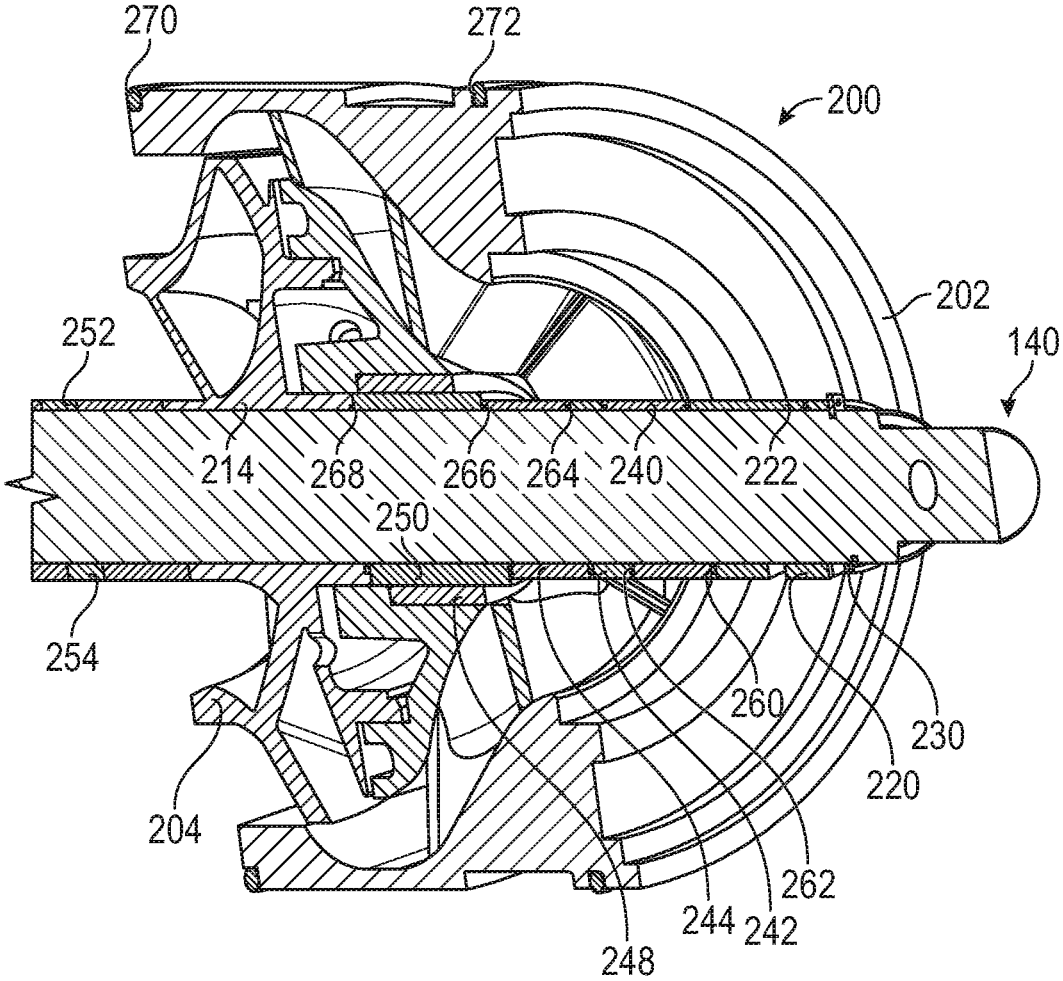
FIG. 11 is a cross-section, perspective view of the pump assembly 200 illustrating the busing and driving shaft seals.

Referring now to FIG. 11, in some embodiments, the pump assembly 200 also includes a plurality of sealing elements disposed axially between adjacent concentric components along the driving shaft 140, and between the concentric component and the driving shaft 140. A sealing element 260 is disposed between the axial biasing member 220 and the bushing 240. A sealing element 262 is disposed between the bushing 240 and the bushing 242. A sealing element 264 is disposed between the bushing 242 and the bushing 244. A sealing element 266 is disposed between the bushing 244 and the inner diffuser bushing 250. A sealing element 268 is disposed between the inner diffuser bushing 250 and the rotor 204 adjacent the rotor support interface 214. In some embodiments, the sealing elements are O-rings, annular seal assemblies, or seal rings. During operation of the pump assembly 200 and the multi-stage pump assembly 100, the sealing elements 260, 262, 264, 266, 268 are axially compressed between the two corresponding concentric components to provide a seal. The seal restricts the fluid that is pumped through the rotor 204 and the diffuser 202 from migrating radially inward toward the driving shaft 140 through the spaces between the rotor support interface 214, the spacing bushings, and the axial biasing member 220. Thus, the sealing elements 260, 262, 264, 266, 268 prevent or at least reduce contact between the driving shaft 140 and the potentially corrosive pumped fluids, thereby reducing corrosive damage to the driving shaft 140.

Still referring to FIG. 11, each diffuser 202 of the multi-stage pump assembly 100 may also include one or more annular elastic members, such as O-rings, disposed about a radially outer surface or groove of the diffuser 202. During assembly, when the driving shaft 140, the diffuser(s) 202, the rotor(s) 204, and the corresponding concentric components along the drive shaft 140 are inserted within the barrel 110, the annular elastic members engage with an inner surface (e.g., a cylindrical inner surface) of the barrel 110 so that the diffusers 202 are in direct contact with the inner surface of the barrel 110. In some embodiments, an annular elastic member 270 is disposed in a first groove of the diffuser 202 and an annular elastic member 272 is disposed in a second groove of the diffuser 202. As a result, vibrations and deflections of the driving shaft 140 during pumping operations are absorbed by the elastic coupling of the stator(s) 202 and the barrel 110 via the annular elastic members 270, 272. Failures of the driving shaft 140, the rotor(s) 204, and the diffuser(s) 202 due to such vibrational deflections are reduced. Also, in some embodiments, the elastic members 270, 272 disposed about the diffusers 202 may sealingly engage with the inner surface of the barrel 110 so that fluid (e.g., the pumped fluid) is restricted from flowing radially outward from the stator(s) 202 and to the inner surface of the barrel 110 during pumping operations. As a result, at least portions of the inner surface of the barrel 110 (and the outer surface of stator(s) 202) can be isolated from the potentially corrosive pumped fluids.

In the various embodiments described herein, a spring like elastic element 220 is used to generate an axial force that is concentric to the driving shaft 140 so that longitudinal components that are concentric on the driving shaft 140 like the rotor 204 and the spacing bushings are kept in constant compression. Because the rotor 204 and the spacing bushings are axially captured by the retention members 258, 230 while the spring like elastic element 220 is exerting a pre-loaded compression force on same, the driving shaft 140 itself is put into tension. The tension in the driving shaft 140 varies the shaft's natural frequencies so that the shaft passes more easily through the various resonant frequencies during the ramp up or ramp down of pumping operations. Additionally, the spring like elastic element 220 attenuates sudden variations in the shaft's length. Typically, these variations occur when the shaft passes through the various resonant frequencies. Moreover, the spring like elastic element 220 acts as a tolerance compensation element since it will accommodate any variation in length of the shaft's concentric components. Furthermore, vibrational damping can be generated by using appropriate materials. In still further embodiments, sealing elements are provided along the driving shaft 140 and in between the concentric bushings, rotor interface, and biasing member to prevent migration of pumped fluids in the rotor and diffuser flow paths to the driving shaft 140. Corrosive pumped fluids are prevented from contacting and corroding the driving shaft 140. Additionally, in some embodiments, elastic sealing elements are placed between each diffuser 202 and the surrounding pipe housing or barrel 110. Therefore, the corrosive pumped fluids can be prevented or slowed from migrating radially outward toward the barrel 110 or radially inward toward the driving shaft 140, which helps preserve the integrity and life of these components.

In various embodiments described herein, a machined spring or other outer concentric biasing member is squeezed or compressed against a retention member about the inner drive shaft to then impart a tension in the inner drive shaft. Once locked into compression, the machined spring or outer concentric biasing member tenses up the inner driving shaft to dampen or attenuate oscillations that happen in the driving shaft. The internal driving shaft seals and the outer diffuser seals keep process fluids from getting at sensitive parts of the pump assembly 200.

While various embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A pump, comprising:

a rotatable driving shaft having a central axis;

two retention members disposed on the rotatable driving shaft;

a rotor disposed on the rotatable driving shaft between the two retention members;

a bushing disposed on the rotatable driving shaft between the two retention members;

a diffuser disposed about the rotatable driving shaft and adjacent the rotor such that the rotor is rotatably disposed within the diffuser; and an axial biasing member disposed on the shaft and axially pre-loaded to compress the axial biasing member, the rotor, and the bushing between the two retention members and impart a tension in the rotatable driving shaft.

2. The pump of claim 1, further comprising a plurality of bushings disposed on the rotatable driving shaft between the two retention members, wherein a first subset of the bushings is disposed on a first axial side of the rotor, and a second subset of the bushings is disposed on a second axial side of the rotor.

3. The pump of claim 2, wherein the first axial side is opposite the second axial side, and wherein the axial biasing member is configured to axially compress the plurality of bushings against one another, and against the rotor.

4. The pump of claim 2, further comprising a sealing element disposed between at least two of the plurality of bushings and against the rotatable driving shaft.

5. The pump of claim 1, further comprising a sealing element disposed between the rotor and the bushing at the rotatable driving shaft.

6. The pump of claim 1, further comprising:

an outer housing having an inner surface; and an annular elastic member disposed about the diffuser and engaging the inner surface.

7. The pump of claim 6, wherein the annular elastic member sealingly engages with the inner surface.

8. The pump of claim 1, wherein the axial biasing member is elastic.

9. The pump of claim 8, wherein the axial biasing member is metal.

10. The pump of claim 8, wherein the axial biasing member is non-metal.

11. The pump of claim 8, wherein the axial biasing member is a machined spring.

12. A pump, comprising:

a rotatable driving shaft having a central axis;

two retention members disposed on the rotatable driving shaft;

a rotor disposed on the rotatable driving shaft between the two retention members;

a plurality of bushings disposed on the rotatable driving shaft between the two retention members and on each side of the rotor; and an axial biasing member disposed on the shaft and axially pre-loaded to compress the axial biasing member, the rotor, and the plurality of bushings between the two retention members and impart a tension in the rotatable driving shaft.

13. The pump of claim 12, wherein the axial biasing member is pre-compressed, and the axial biasing member is expanded against one of the retention members to create the axial pre-load.

14. The pump of claim 12, further comprising a sealing element disposed between the rotor and one of the plurality of bushings to prevent radial migration of a pumped fluid to the rotatable driving shaft.

15. The pump of claim 12, wherein the rotatable driving shaft, the plurality of bushings, the rotor, and the axially pre-loaded biasing member compressed between the two retention members form a centrifugal pump assembly, and a plurality of axially pre-loaded centrifugal pump assemblies is disposed on the rotatable driving shaft.

16. The pump of claim 15, wherein the pump comprises a resonant frequency during use, and wherein the plurality of axially pre-loaded centrifugal pump assemblies impart a tension in the rotatable driving shaft that raises the resonant frequency.

17. The pump of claim 15, further comprising a barrel and two end elements, and wherein the plurality of axially pre-loaded centrifugal pump assemblies disposed on the rotatable driving shaft is inserted into the barrel and clamped by the two end elements.

18. A method of assembling a pump, comprising:

assembling a retention member, a plurality of bushings, a rotor, a diffuser, and an axial biasing member on a rotatable driving shaft having a central axis;

axially compressing the axial biasing member;

coupling a second retention member on the rotatable driving shaft;

expanding the axial biasing member against the second retention member to an axially pre-loaded position; and imparting a tension to the rotatable driving shaft in response to the axially pre-loaded position of the axial biasing member.

19. The method of claim 18, further comprising disposing sealing elements between the rotor, the axial biasing member, and selected bushings, and against the rotatable driving shaft to prevent a working fluid from migrating to the rotatable driving shaft during use of the pump.

20. The method of claim 18, further comprising raising a resonant frequency of the pump during use in response to the tension imparted to the rotatable driving shaft.

* * * * *